US005806590A

United States Patent [19]

Lembcke

[11] Patent Number: 5,806,590

[45] Date of Patent: Sep. 15, 1998

[54] TORQUE-RESISTANT SLIP

[75] Inventor: Jeffrey J. Lembcke, Houston, Tex.

[73] Assignee: Baker Hughes Incorporated, Houston, Tex.

[21] Appl. No.: 926,534

[22] Filed: Sep. 10, 1997

Related U.S. Application Data

[63] Continuation of Ser. No. 594,631, Feb. 2, 1996, abandoned.

[51] Int. Cl.[6] ..... E21B 23/01

[52] U.S. Cl. ..... 166/134; 166/217; 175/81

[58] Field of Search ..... 166/134, 216, 166/217, 210, 117.6, 117.7; 175/81

[56] References Cited

U.S. PATENT DOCUMENTS

| | | | |
|---|---|---|---|
| 1,110,639 | 9/1914 | Moore | 166/117.7 |
| 1,619,268 | 3/1927 | Rasmussen | 166/217 |
| 2,009,164 | 7/1935 | Colmerauer | 166/210 |
| 2,145,422 | 1/1939 | Kinzbach . | |
| 2,338,788 | 1/1944 | Walker . | |
| 2,361,094 | 10/1944 | Hammer | 166/217 |
| 3,322,006 | 5/1967 | Brown | 166/177.7 |
| 3,380,528 | 4/1968 | Timmons | 166/216 |
| 4,811,785 | 3/1989 | Weber | 166/217 |
| 5,275,239 | 1/1994 | Obrejanu | 166/215 |
| 5,335,737 | 8/1994 | Baugh . | |
| 5,341,873 | 8/1994 | Carter et al. . | |
| 5,427,179 | 6/1995 | Bailey et al. | 166/117.6 |
| 5,437,340 | 8/1995 | Lee et al. | 175/61 |
| 5,452,759 | 9/1995 | Carter et al. | 166/117.6 |
| 5,501,281 | 3/1996 | White et al. | 166/387 |
| 5,623,991 | 4/1997 | Jani | 166/217 |

FOREIGN PATENT DOCUMENTS

| | | | |
|---|---|---|---|
| 701043A2 | 3/1996 | European Pat. Off. . | |
| 759701 | 9/1980 | Russian Federation | 166/217 |

*Primary Examiner*—Hoang C. Dang
*Attorney, Agent, or Firm*—Rosenblatt & Redano P.C.

[57] ABSTRACT

The invention relates to a slip design with substantially longitudinally oriented wickers, which can be used alone or in combination with transversely oriented wickers, to secure a downhole tool, such as a bridge plug or packer, against rotational forces, such as those imparted from a whipstock, as well as longitudinal forces, such as those ultimately delivered by pressure fluctuations from uphole or downhole. The longitudinally oriented wickers are further cammed against the casing since any imparted torque on the packer body contacts a corner or edge of the slip, imparting to it a camming action making it dig further into the casing surface.

11 Claims, 3 Drawing Sheets

TORQUE-RESISTANT SLIP

This application is a continuation of application Ser. No. 08/594,631, filed on Feb. 2, 1996, now abandoned.

FIELD OF THE INVENTION

The field of this invention relates to securement devices for packers and plugs, particularly those used as supports for whipstocks.

BACKGROUND OF THE INVENTION

Whipstocks are deviation devices that are used to kick off a lateral in a borehole. Typically, whipstocks are supported by anchoring devices such as plugs or packers. The packers can be permanent or retrievable, and are generally set mechanically or hydraulically. These packers typically involve the use of relative movement to compress a sealing element against a casing to ensure a seal. The position of the packer is further secured by a series of slips which are metallic anchoring dogs that have serrated fronts to bite into the casing. The relative movement which is created mechanically or hydraulically in the setting procedure results in the slips riding along a tapered element known as a cone so that they are cammed outwardly toward the casing. With the slips secured against the casing, a body lock ring holds the set of the slips as well as the compressed sealing element, which is also in contact with the casing.

In normal applications of bridge plugs and packers, not necessarily including the use of whipstocks, the gripping members or slips are designed to hold the packer or plug stationary against a sudden or gradual increase in forces from up-hole or downhole. That is to say, the serrated surfaces of the slips, which are in contact with the casing, are designed to retain the packer position longitudinally against uphole or downhole forces.

When combining the use of a packer or plug with a whipstock, additional rotational forces can be applied to the packer or plug due to forces transmitted during milling. Those skilled in the art will appreciate that after a packer is set and a whipstock is in position, supported by the packer, the milling operation can result in the rotational force of the mill being transmitted to the packer during the milling of the casing. This occurs when the starter or window mill, which is the lead mill in a string of mills generally initially supported by the whipstock, is set into rotary motion and periodically makes some contact with the whipstock tapered face. When the rotating mill makes a contact with the whipstock face during the milling of a lateral window in the casing, the torque reaction in the whipstock is transmitted to the packer. In turn, the torque reaction is transmitted to the contact between the slips and the casing.

In the past, efforts to improve the structural integrity of the support for the packer with the casing, especially in view of a potential for a rotational applied force, have concentrated along the lines of securing the slips to the body of the packer, using various combinations of slots or keyways. The purpose of such techniques was to rotationally lock the slip to the body of the packer. Other designs previously used are depicted in FIGS. 1 and 2. FIG. 1 illustrates a front view of the wickers on a typical slip, which are generally oriented transversely to the longitudinal axis of the packer. In prior designs, the wickers, which are generally transversely oriented, have had notches cut out of them in longitudinally aligned rows. The rationale for doing this was that the edges of each of the wickers would dig into the casing to resist rotational force. However, the disadvantage of such a design was that the points of contact with the casing were so small that chipping and breaking had occurred, and the contact area also was so small so as to minimize the ability to grip as the torque increased.

Other prior wicker designs for slips are shown in U.S. Pat. Nos.: 2,145,422; 2,338,788; 5,335,737; 5,341,873; 5,427,179; 5,437,340; and 5,452,759.

Accordingly, the present invention contemplates an improvement in the ability of packers and plugs to resist torque. This is accomplished by allowing some of the slips to have principally longitudinally oriented wickers instead of the principally transversely oriented wickers used in the past, as illustrated in FIG. 1, and even those prior designs which did not even employ the breaks illustrated in FIG. 1 in a substantially longitudinal wicker design.

By providing one or more slips in a packer or plug with essentially longitudinally oriented wickers, the ability to resist torque is significantly enhanced without materially affecting the ability of the remaining slips to secure the packer against longitudinal movement due to pressure fluctuations from uphole or down-hole.

SUMMARY OF THE INVENTION

The invention relates to a slip design with substantially longitudinally oriented wickers, which can be used alone or in combination with transversely oriented wickers, to secure a downhole tool, such as a bridge plug or packer, against rotational forces, such as those imparted from a whipstock, as well as longitudinal forces, such as those ultimately delivered by pressure fluctuations from uphole or downhole. The longitudinally oriented wickers are further cammed against the casing since any imparted torque on the packer body contacts a corner or edge of the slip, imparting to it a camming action making it dig further into the casing surface.

DETAILED DESCRIPTION OF THE PREFERRED EMBODIMENT

Figure 1:
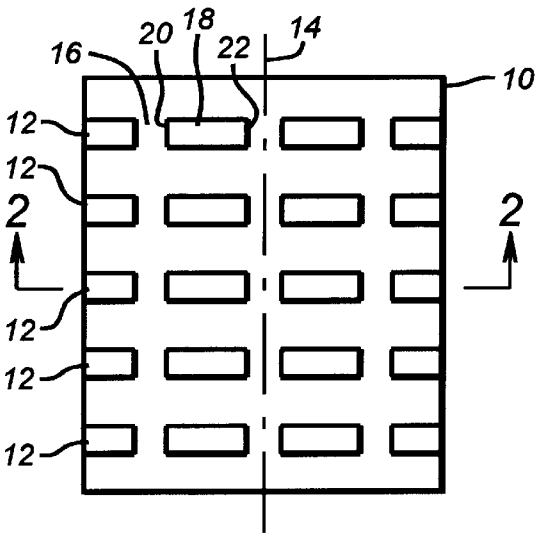
(PRIOR ART) FIG. 1
FIG. 1 is a front view of a slip, showing transversely oriented wickers that have been interrupted, which is one prior art way of trying to improve ability to withstand torque.
Figure 2:
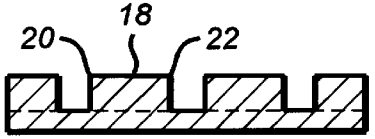
(PRIOR ART) FIG. 2
FIG. 2 is a section view through lines 2—2 of FIG. 1.
Figure 3:
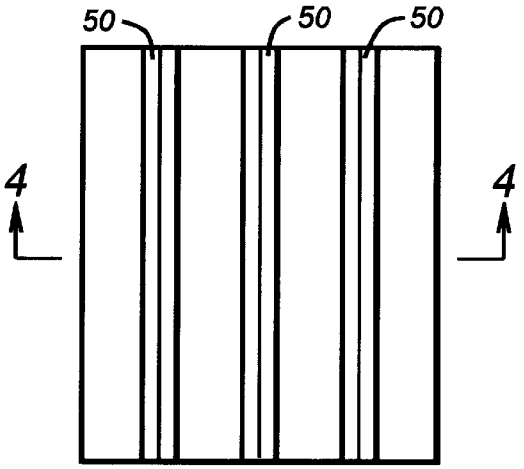
FIG. 3 is a front elevational view of the slip of the present invention, showing the orientation of substantially longitudinally oriented wickers.
Figure 3A:
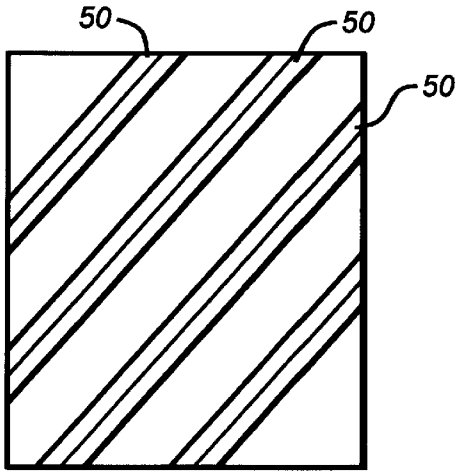
FIG. 3*a* is a front elevational view showing oblique wickers.
Figure 4:
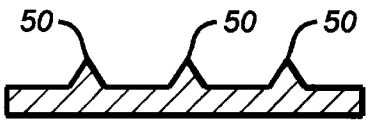
FIG. 4 is a section view along lines 4—4 of FIG. 3.

FIG. 1 is a prior art frontal elevational view of a slip with the longitudinal centerline marked. The slip 10 has a series of wickers 12, which are oriented prependicularly to the centerline 14. Each of the wickers 12 has cutouts 16 breaking up the transverse wickers 12 into subsegments 18. Each of the subsegments 18 have ends 20 and 22. When the slip 10, as shown in FIG. 1, is subjected to a rotational force and the wickers 12 are engaged to a casing, the idea was that the ends 20 or 22, depending on the direction of rotation, would dig into the casing and resist the applied rotational force. The problem in this design illustrated in FIGS. 1 and 2 is that the ends 20 and 22 could easily fracture or break and, therefore, provide only limited resistance to slipping with respect to the casing when an applied torque came to the packer or plug body from a whipstock during the milling of a window in the casing. It should be noted that while the most likely occurrence of an applied torque to the packer or plug which harbors one or more slips, such as 10, is from a milling operation involving a whipstock, other types of torque inputs to a slip are intended to be covered by the scope of this invention.

Figure 7:
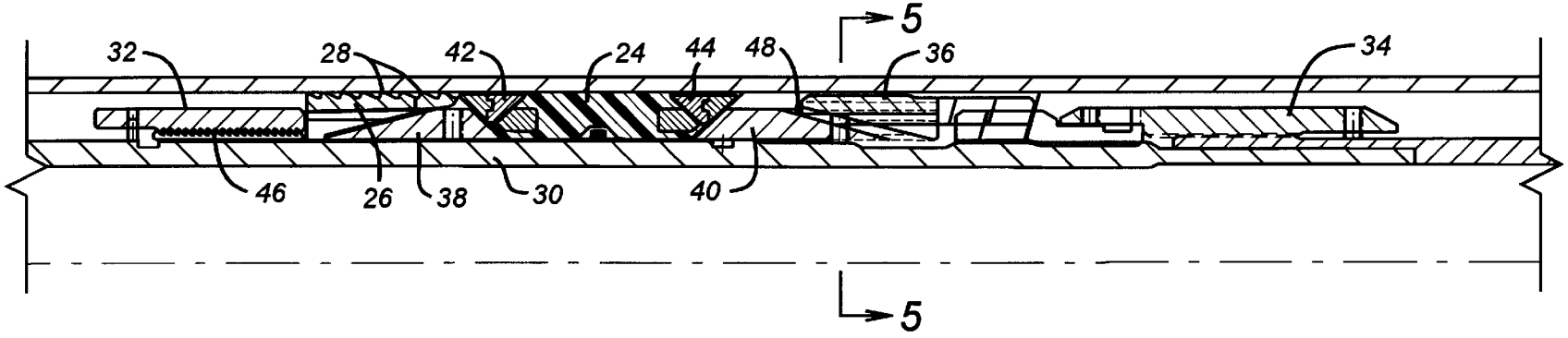
FIG. 7 shows how the slips with substantially longitudinal orientation on the wickers can be combined with slips having transverse orientation on the wickers, in a partial view of the securing and sealing assembly for a downhole tool, such as a packer.

Referring to FIG. 7, a typical assembly of a sealing element 24 is shown in an expanded condition. Uphole from sealing element 24 is a series of slips 26 having a plurality of wickers 28 which are generally aligned perpendicular to the longitudinal axis of the packer. The wickers 28, in the traditional manner, are placed there to resist uphole or downhole movement of the body 30 of a packer or a plug. In the known manner, relative movement is created so that while body 30 is retained, the ring 32 is pushed downwardly by a setting tool (not shown). Opposing the downward force applied on ring 32, by a setting tool which is not shown, is ring 34, which is supported by body 30. The upper slips 26 and lower slips 36 are then squeezed between rings 32 and 34 to bias the slips 26 and 36 outwardly, respectively, on cones 38 and 40. The sealing element 24 is in between the cones 38 and 40 and is itself compressed. Triangular members 42 and 44 aid in prevention of extrusion of the sealing element 24. The set position is retained by a body lock ring 46, which prevents uphole movement to hold the set of the slips 26 and 36, as well as the sealing element 24.

Figure 5:
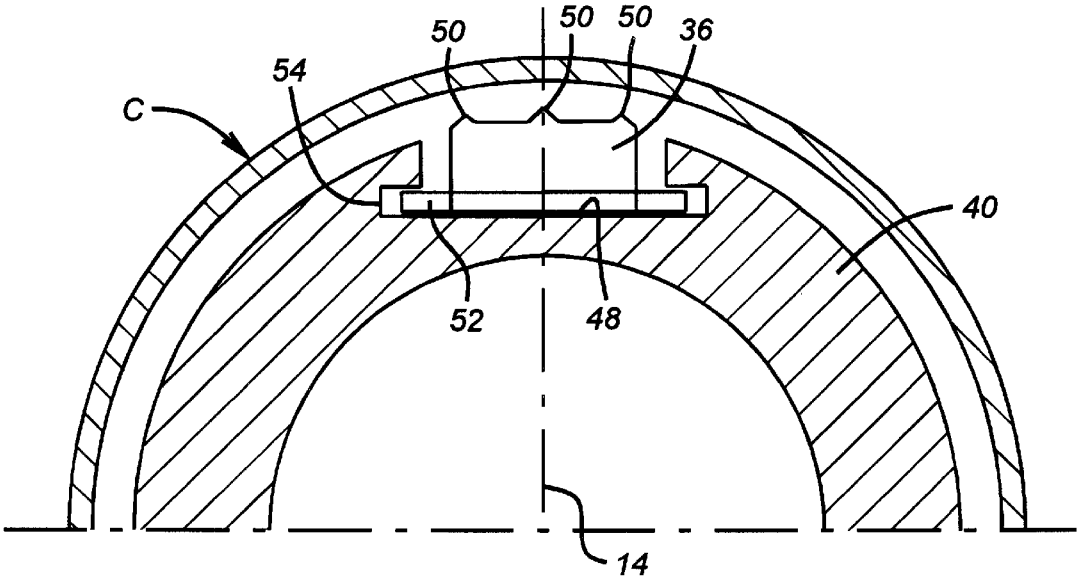
FIG. 5 illustrates the substantially longitudinally oriented wickers in section, showing how they are mounted to a cone or other retaining device.
Figure 6:
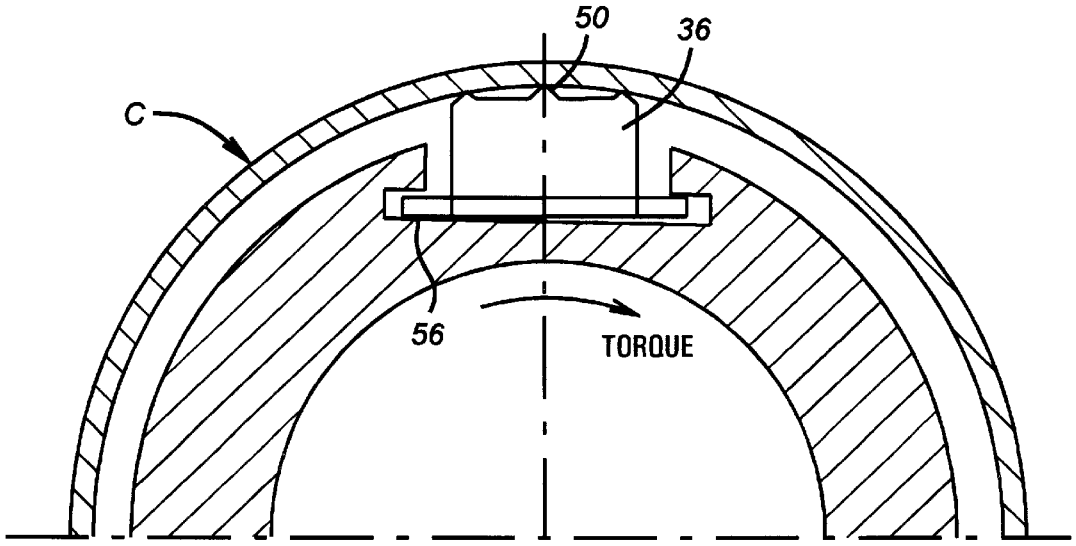
FIG. 6 is the view of FIG. 5, showing the camming action after torque is applied to the body of the packer.

Section 5—5 of FIG. 7 is shown in more detail as FIGS. 5 or 6. The cone 40 has a sloping surface 48, which acts to cam the lower slips 36 outwardly when a downward force is exerted by the setting tool (which is not shown) on ring 32. Referring to FIGS. 5 and 6, the sloping surface 48 is illustrated underneath the lower slip 36. FIG. 5 is a view looking down the centerline, such as 14, of the apparatus of the present invention. It can be seen that the wickers 50 are in substantial alignment with the centerline 14 on lower slips 36. This is to be contrasted with the upper slips 26 which have the wickers 28 perpendicular to the centerline 14, as shown in FIG. 7. While a design showing upper slips 26 with transverse wickers 28, and lower slips 36 with substantially parallel wickers 50 have been shown in FIGS. 5, 6, and 7, it is within the spirit of the invention to provide numerous alternative arrangements of wickers on the slips. For example, the reverse can be applied with the lower slips 36 having transverse wickers and the upper slips 26 having substantially parallel wickers with respect to the centerline 14. Alternatively, in a given row of upper slips 26, there can be an alternation of wickers on adjacent slips, with one slip 26 having substantially parallel wickers while the next adjacent slip has perpendicular wickers. Depending on the specific need, other sequences can be used such as every other slip on the upper or lower set can be with substantially parallel wickers, such as 50, or any other alternating combination as between the upper row, such as 26, or the lower row, such as 36.

By combining, in a single tool, slips having orientation substantially parallel to the centerline, such as 14, as well as slips having wickers perpendicular to the centerline 14, the tool resists uphole or downhole forces from pressures applied below or above, as well as torque applied from a mill trying to mill a window in a casing using a whipstock. The grip of the slips having wickers that are substantially parallel to the centerline 14 is magnified by the camming action illustrated in FIG. 6. The slip 36 has a base flange 52, which loosely fits in a mating groove 54 in the cone 40. When a torque is applied to the body 30, which in turn is translated to the cone 40, the loose fit between the flange 52 and its matching groove 54 provides a near end contact, as shown in FIG. 6. The contact point 56 acts as a lever on the slip 36 to make the wickers 50 dig in that much harder into the adjacent casing C so that the additional bite from this camming or lever action, illustrated by comparing FIGS. 5 and 6, enhances the contact force and contact area of wicker 50 against casing C, thus giving the design of the present invention and enhanced ability to resist the applied torque. The lever action can be designed to enhance the grip to close to the elastic limit of the casing. While a lever action is described other types of force enhancement mechanisms such as cams, lobes, wedges and the like used to apply a force to enhance contact against torque induced rotation are all within the spirit of the invention. The lever action is bidirectional so that an enhanced contact force results when clockwise or counterclockwise torque is applied. In other words the extra force applied adjacent a longitudinal end in response to applied torque occurs regardless of direction of applied torque. It should be noted that while cones can be used to radially urge the slips out toward the casing or tubing the cones have only in the past applied a normal (or radial) force against the tubing or casing. The invention deals with an enhancement to such radial force by use of cams, levers or the like generally acting near at least one longitudinal edge of the slips.

While beveled wickers are described, other shapes can be employed without departing from the spirit of the invention. Tungsten carbide buttons that provide the necessary contact area in a generally parallel orientation to the centerline 14 can equally serve the purpose of the wicker design illustrated in FIGS. 5 and 6.

Those skilled in the art will appreciate that by providing additional contact area in an appropriate orientation to dig into the casing C when a torque is applied, the packer or plug is more likely to remain in position and resist an applied torque. These applied torques primarily occur when the packer or plug supports a whip-stock and the milling operation for a window in the casing C is ongoing, with an occasional contact of the mill against the whipstock. As a result of such contact, torque is applied to the whipstock, which is transmitted to the slips which are in contact with the casing C. By using generally longitudinally oriented wickers 50 in whatever design, in combination with the lever action due to the loose mount with respect to a torque applied, as illustrated in FIG. 6, an increased force can be applied to the slips, such as 36, to improve the bite of the wickers 50 into the casing C.

While the preferred embodiment indicates wickers substantially aligned with the longitudinal axis 14 to best resist applied torque, it is within the purview of the invention to include certain angular misalignments from the longitudinal axis. The advantage of the present invention comes from the enhanced contact area of the wicker design, with respect to a turning force or moment, which occurs primarily during milling using whipstocks. Accordingly, other wicker designs on a slip that enhance the contact area over that of the prior art illustrated in FIGS. 1 and 2 are also within the purview of the invention. Thus, more complicated patterns of wickers on a slip could also function, even in a single-slip design to resist not only uphole or downhole forces from applied pressures but also from torque. Such a wicker design could encompass some wickers being oriented substantially parallel to the longitudinal axis 14, and others on the same slip perpendicularly oriented to the longitudinal axis 14. Even oblique wickers 50, which are not perpendicular to the longitudinal axis 14, and which provide an enhanced gripping force over the prior designs of FIGS. 1 and 2 on an individual slip, are also within the purview of the invention.

The foregoing disclosure and description of the invention are illustrative and explanatory thereof, and various changes in the size, shape and materials, as well as in the details of the illustrated construction, may be made without departing from the spirit of the invention.

I claim:

1. A downhole tool having at least one slip body for securing a downhole tool body having a longitudinal axis to a casing or tubular in a wellbore, said tool comprising:

a tool body;

a slip body having a pair of opposed ends mounted to said tool body, having a grip face which is oriented to face the casing or tubular; and a support for said slip body mounted to said tool body which engages adjacent ends of said slip body in a loose fit to provide a lever action based on near-end contact substantially upon initial movement of said support in response to an application of torque in either of two opposed directions to the tool body to transmit said torque to said slip body, said support, by said engagement substantially upon initial movement of said support, acting to increase force adjacent one or the other of said ends of said slip body against the casing or tubing for enhancement of the grip by said slip against an applied torque.

2. The tool of claim 1, wherein:

at least one wicker on said face, said wicker oriented on said face in a manner so as to enhance the grip of said slip to the casing or tubular in response to a torque applied to said body; and said wicker is oriented obliquely but not perpendicularly to said longitudinal axis of said tool body.

3. The tool of claim 1, wherein:

at least one wicker on said face, said wicker oriented on said face in a manner so as to enhance the grip of said slip to the casing or tubular in response to a torque applied to said body; and said wicker is oriented substantially parallel to said longitudinal axis of said tool body.

4. The tool of claim 3, wherein said tool body further comprises:

a plurality of said slip bodies, each having at least one of said wickers thereon.

5. The tool of claim 4, further comprising:

a plurality of slip bodies on said tool body, having wickers thereon oriented substantially transversely to the longitudinal axis of said tool body.

6. The tool of claim 1, wherein:

said slip body comprises a base and said support comprises opposed grooves, said base loosely fitting in said opposed grooves so that upon application of a torque to said tool body, at least one of said grooves engages said base adjacent one end thereof to lever said slip into the casing or tubing to enhance the grip of said slip against said applied torque.

7. The tool of claim 1, wherein:

said support enhances said grip regardless of the direction of the torque applied to said tool body.

8. The tool of claim 1, wherein:

said tool body further comprises at least one cam to contact at least one end of said slip body to enhance applied force through said slip body to the casing or tubular so as to increase resistance to slippage in reaction to applied torque to said tool body.

9. The tool of claim 1, wherein:

said tool body further comprises at least one wedge to contact at least one end of said slip body to enhance applied force through said slip body to the casing or tubular so as to increase resistance to slippage in reaction to applied torque to said tool body.

10. The tool of claim 6, wherein:

said support enhances said grip regardless of the direction of the torque applied to said tool body.

11. The tool of claim 8, wherein:

said support enhances said grip regardless of the direction of the torque applied to said tool body.

* * * * *